US009675128B2

(12) United States Patent
Allen et al.

(10) Patent No.: US 9,675,128 B2
(45) Date of Patent: Jun. 13, 2017

(54) ERGONOMIC FACEGUARD FOR AN ATHLETIC HELMET

(71) Applicant: Ampac Enterprises Inc., Shirley, MA (US)

(72) Inventors: Jena Allen, Shirley, MA (US); Stan Jurga, Jr., Shirley, MA (US); Shyan-Wei Chen, Taipei Hsien (TW)

(73) Assignee: Ampac Enterprises Inc., Shirley, MA (US)

( * ) Notice: Subject to any disclaimer, the term of this patent is extended or adjusted under 35 U.S.C. 154(b) by 922 days.

(21) Appl. No.: 13/874,709

(22) Filed: May 1, 2013

(65) Prior Publication Data

US 2014/0325727 A1 Nov. 6, 2014

(51) Int. Cl.
*A42B 3/20* (2006.01)

(52) U.S. Cl.
CPC ..... *A42B 3/20* (2013.01)

(58) Field of Classification Search
CPC .... A42B 3/20; A42B 3/18; A42B 3/22; A42B 3/225
See application file for complete search history.

(56) References Cited

U.S. PATENT DOCUMENTS

2007/0250990 A1* 11/2007 Brown ..... A42B 3/06 2/414
2007/0250992 A1* 11/2007 Brown ..... A42B 3/20 2/424
2009/0083900 A1* 4/2009 Wallace ..... A42B 3/227 2/424
2011/0138520 A1* 6/2011 DeBoer ..... A42B 3/20 2/425

* cited by examiner

*Primary Examiner* — Shaun R Hurley
*Assistant Examiner* — Andrew W Sutton
(74) *Attorney, Agent, or Firm* — Smith, Gambrell & Russell, LLP

(57) ABSTRACT

An ergonomic faceguard for a helmet, and a helmet including the ergonomic faceguard; the faceguard including a wire grid having a plurality of horizontal wires. The plurality of horizontal wires includes a horizontal wire configured to extend proximate to a user's chin, the horizontal wire including a pair of lateral sections for engaging a shell of a helmet and a front section extending between the lateral sections, with the lateral sections extending along a common plane and the front section deviating from the plane along which the lateral sections extend. The front section has an anterior point that is elevated at a height that is greater than a height of the lowest point in the front section.

19 Claims, 8 Drawing Sheets

ERGONOMIC FACEGUARD FOR AN ATHLETIC HELMET

FIELD OF THE INVENTION

The present invention relates to protective headgear and, more particularly, to a faceguard for protective headgear. In particular, the present invention relates to an athletic helmet having an ergonomic faceguard.

BACKGROUND OF THE INVENTION

In sports, there is often a risk of injury from a moving ball or other projectile. For example, when batting in baseball or softball there is a risk that a player may be struck in the head with the ball. Given the risk of injury, it is common for players to wear protective headgear. For example, a batting player might wear a helmet 10 such as that shown in FIG. 1, which includes a shell 11 having a visor 12 and a faceguard 20. The faceguard 20 includes an upper horizontal wire 21, a lower horizontal wire 22, and vertical wires 23, 24 and 25.

In conventional batting helmets, such as the helmet 10, the faceguard 20 is designed to protect the player's face from being struck by a ball. In this regard, the lower horizontal wire 22 of the faceguard 20 is formed in a constant parabolic shape that extends forward of the player's face and below the player's chin. However, for some players, the shape of the lower horizontal wire 22 is problematic.

In particular, different baseball/softball players often have different batting stances. In preparing to swing, some players will hold a bat at a lower height while other players will hold a bat at a higher height. As shown in FIG. 1, a player who holds a bat 41 at a higher height may bring their shoulder 32 up close to their chin 31. However, when wearing a helmet such as the helmet 10, the lower horizontal wire 22, which extends below the chin 31, often interferes with such a batting stance.

For example, the location of the horizontal wire 22 between the player's chin 31 and their shoulder 32 may cause the player to assume another, less preferred and/or improper batting stance. In another example, as shown in FIG. 1, a player may raise their shoulder 32 and turn their head such that the lower horizontal wire 22 extends in front of their shoulder 32. With a stance such as that shown in FIG. 1, when the player swings the bat 41 and rotates their shoulder 32 to follow through the swing, their shoulder 32 will collide with the horizontal wire 22. Collision of the shoulder 32 with the lower horizontal wire 22 may shift the helmet 10 on the player's head, jerk the player's head, and/or deflect the player's swing. In addition, attempts to accommodate for the interference from the lower horizontal wire 22 may lead a player to adopt improper batting practices. For example, a player may adjust their swing such that their shoulder 32 travels underneath the lower horizontal wire 22, or a player may lift their head during the swing. However, such batting practices result in improper swing mechanics. In particular, rotating the shoulder 32 at a lower height increases the likelihood that the player will hit the bottom of the ball, sending it higher in the air and increasing the chances that the ball will be caught and result in an out. In addition, lifting one's head when swinging makes it difficult to watch the ball, and increases the likelihood that a player will miss the ball.

The foregoing problems are common to both baseball and softball, as many leagues require players to wear a faceguard when batting. However, the foregoing problems tend to be more frequent in softball. In particular, softball pitchers normally throw the ball in an underhand motion such that the ball rises from a lower height at the pitching position to a higher height at the batting position. As such, it is common for a softball player to tilt their head further downward when batting to watch the ball as it rises from the lower pitching height. This increased tilt of the head results in the lower horizontal wire 22 being lower, thereby increasing its interference with a players' batting stance and swing.

While the foregoing examples illustrate problems associated with faceguards in baseball and softball helmets, these problems may likewise occur in other athletic activities where a player wears protective headgear having a faceguard that may interfere with movement of the player's shoulder proximate to their chin.

Accordingly, there is a need in the art for protective headgear having a faceguard that adequately protects the player's face, while at the same time not interfering with the player's movement. In particular, it would be desirable to provide a batting helmet that protects the player's face while not interfering with the player's batting stance and swing mechanics.

SUMMARY OF THE INVENTION

The present invention relates to an ergonomic faceguard for a helmet, and a helmet including the ergonomic faceguard. In one embodiment, there is provided a faceguard for a batting helmet, the faceguard including a wire grid having a plurality of horizontal wires. The plurality of horizontal wires may include a first horizontal wire configured to conform to a visor portion of a batting helmet, a second horizontal wire configured to extend proximate to a user's nose, and a third horizontal wire configured to extend proximate to a user's chin.

In one aspect, the first horizontal wire is the top perimeter of the faceguard and acts as a mount for securing the faceguard to a helmet, while the second horizontal wire is a nasal guard for protecting a user's nose. Meanwhile, the third horizontal wire is a mandible guard that includes a pair of lateral sections for engaging a shell of a batting helmet and a front section extending between the lateral sections, with the lateral sections extending along a common plane and the front section deviating from the plane along which the lateral sections extend.

In one aspect, the front section includes intermediate sections that extend from the lateral sections and a top section that extends between the intermediate sections, with the intermediate sections sloping away from the plane along which the lateral sections of the third horizontal wire extend. The slope of the intermediate sections may be a curved slope, or a straight slope.

In another aspect, the anterior point is configured to approximately align with the sagittal plane of a user's face, and is elevated at a height that is greater than the height of a lowest point in the front section, and the height of a lowest point in the third horizontal wire as a whole.

In a further aspect, the front section has a first curvature when viewed along a first axis, and a second curvature when viewed along a second axis perpendicular to the first axis. The curvature of the front section is such that a length between the anterior point of the front section and a point on the second horizontal wire that is directly above the anterior point and which also aligns approximately with the sagittal plane of a user's face is the shortest length between the front section and the second horizontal wire.

The present invention also relates to a method of manufacturing the faceguard and/or athletic helmet by shaping the faceguard from metal, plastic, or a combination thereof. In one embodiment, the method of manufacturing includes shaping the individual wires in the wire grid separately and affixing the wires to one another to form the wire grid. In another embodiment, the method of manufacturing includes shaping the entire wire grid as a monolithic structure. In these embodiments, the wires may be constructed with round, rectangular, oval, or flat cross-sections, and may be either solid or hollow. In addition, different wires in the wire grid may have different cross-section shapes and different cross-section types (e.g. solid or hollow).

Both the foregoing general description and the following detailed description are exemplary and explanatory only and provide an explanation of the invention as claimed. The accompanying drawings are incorporated in and constitute part of this specification, and are included to provide a further understanding of the invention; to illustrate several embodiments of the invention; and, with the description, explain the principles of the invention.

BRIEF DESCRIPTION OF THE DRAWINGS

Further features and advantages of the invention may be ascertained from the following detailed description in connection with the drawings described below.

DETAILED DESCRIPTION OF THE INVENTION

Figure 1:
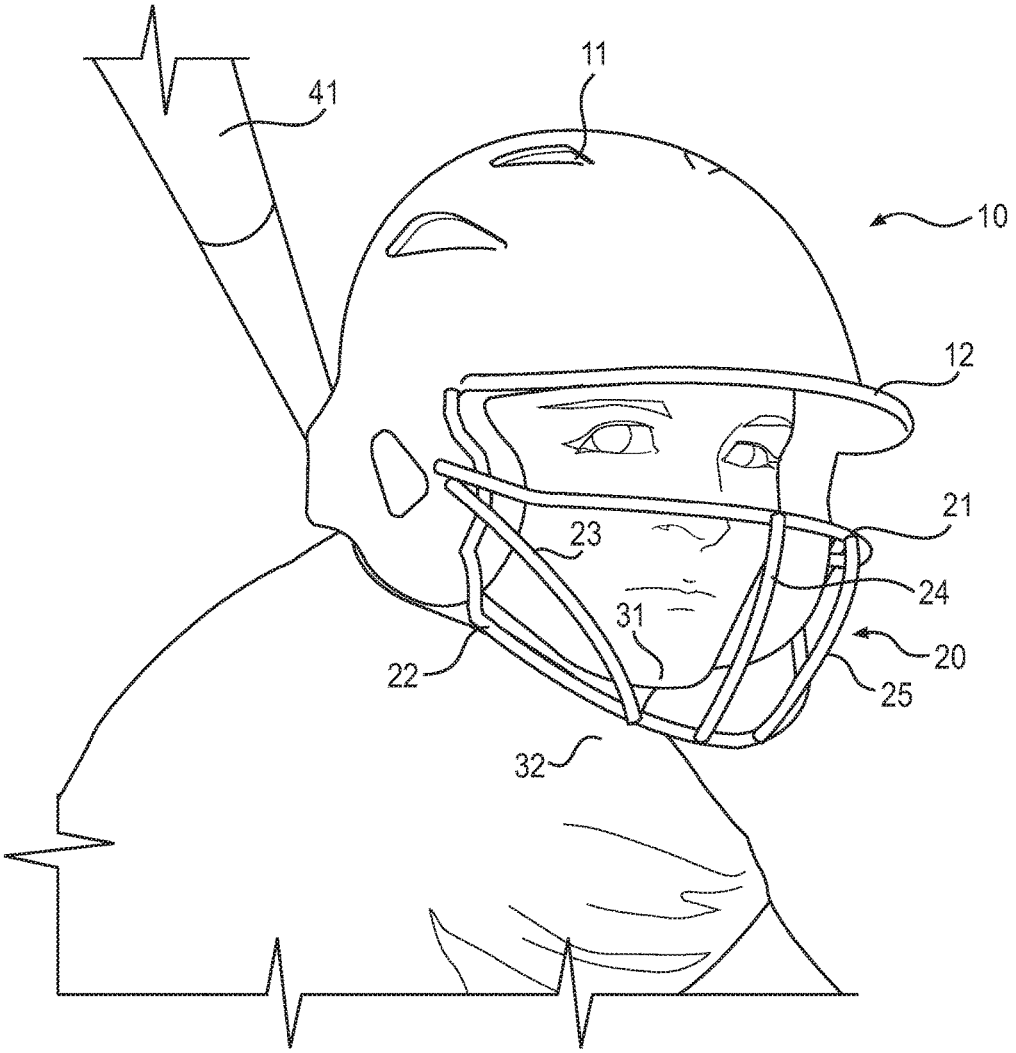
FIG. 1 PRIOR ART
FIG. 1 illustrates a player in a batting stance wearing a helmet with a conventional faceguard.

The present invention relates to protective headgear with a faceguard. In particular, the present invention relates to an athletic helmet, and particularly a batting helmet, with an ergonomic faceguard, and methods of making the faceguard.

The following disclosure discusses the present invention with reference to examples in the accompanying drawings, though does not limit the invention to those examples. For example, although the following discussion addresses exemplary configurations of the novel faceguard in softball and baseball helmets, the inventors contemplate the faceguard to be useful in other athletic headgear, and other types of headgear not limited to athletic use.

Product/Article/Device/Apparatus/System/Headgear

In one embodiment, as shown in FIGS. 2, 3 and 5-8, the headgear is a softball helmet 100 including a shell 110 and a faceguard 200. The shell 110 includes a visor 120; one or more first ports 130 providing ventilation to a wearer; and a plurality of second ports 140 providing openings for a wearer to hear through the shell 110. The shell 110 may also include an inner lining 150 that cushions a wearer from impact forces against the outer surface of the shell 110.

In the embodiment of FIGS. 2-12, the faceguard 200 is in the form of a wire grid 201 that includes a first horizontal wire 210; a second horizontal wire 220; and a third horizontal wire 230. The wire grid 201 further includes a pair of lateral vertical wires 240 and 270, and a pair of front vertical wires 250 and 260. The faceguard 200 protects a user's face, and may be referred to as the shield member 200.

First Horizontal Wire 210

The first horizontal wire 210 is the highest wire in the wire grid 201 and represents the top perimeter of the faceguard 200. The first horizontal wire 210 conforms substantially to a visor 120 on a mating helmet 100, and engages the visor 120 by one or more first fasteners 160. As such, the first horizontal wire 210 may be referred to as the mount 210. In embodiments where the helmet 100 does not include a visor 120, the first horizontal wire 210 may conform substantially to an upper edge in a face opening of the helmet 100 with the first fasteners 160 made to secure the first horizontal wire 210 to the upper edge of the face opening.

In one example, the first fasteners 160 are affixed to the first horizontal wire 210 and engage the shell 110 (at either a visor 120 or a lower edge of a face opening). In another example, the first fasteners 160 are affixed to the shell 110 and engage the first horizontal wire visor 210. In yet another example, the first fasteners 160 are mating arrangements of fasteners on each of the first horizontal wire 210 and the shell 110.

Suitable structures for use as the one or more first fasteners 160 may include: one or more u-shaped clamps; one or more j-shaped hooks; mating arrangements of snap-fasteners; arrangements of openings that align for reception of a secured bolt; and equivalents of the foregoing. The first fastener 160 may also include combinations of the foregoing structures.

Second Horizontal Wire 220

The second horizontal wire 220 may be configured, when the faceguard 200 is affixed to a mating helmet 100 and the helmet is worn by a user, to extend along the user's cheek bones and forward of the user's nose, as shown in FIGS. 2, 5, 7 and 8. As such, the second horizontal wire 220 may be referred to as the zygomatic guard 220 or the nasal guard 220.

Figure 4:
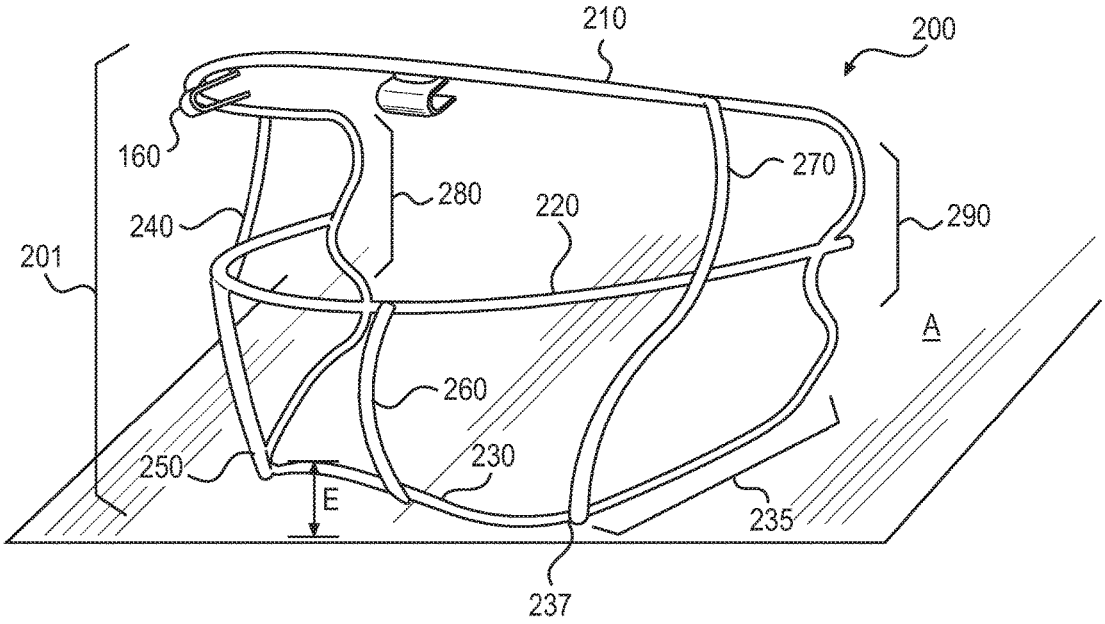
FIG. 4 illustrates a perspective view of the faceguard according to the first embodiment.
Figure 8:
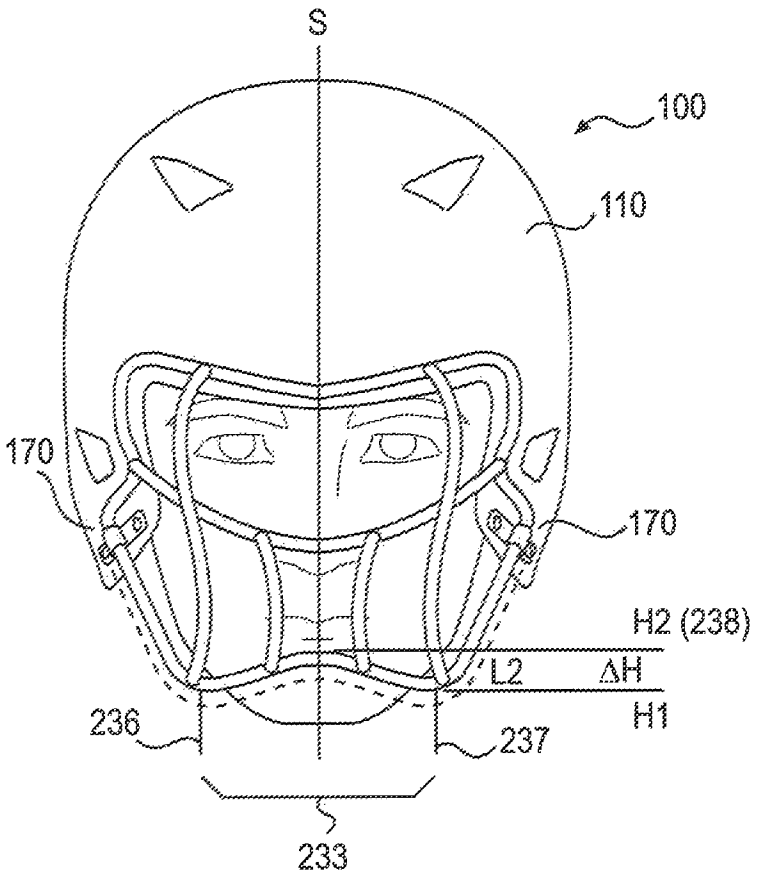
FIG. 8 illustrates a front view of a user wearing the helmet of FIG. 3.
Figure 9:
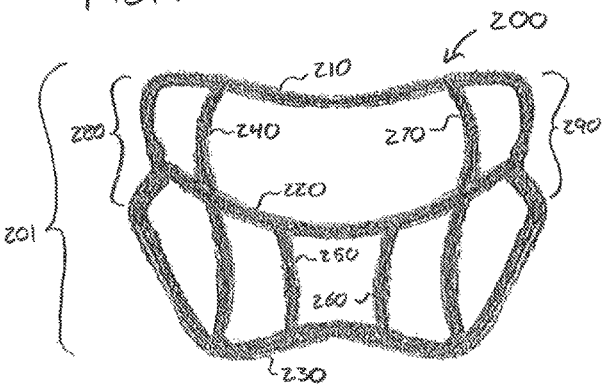
FIG. 9 illustrates a front view of the faceguard of FIG. 4.
Figure 10:
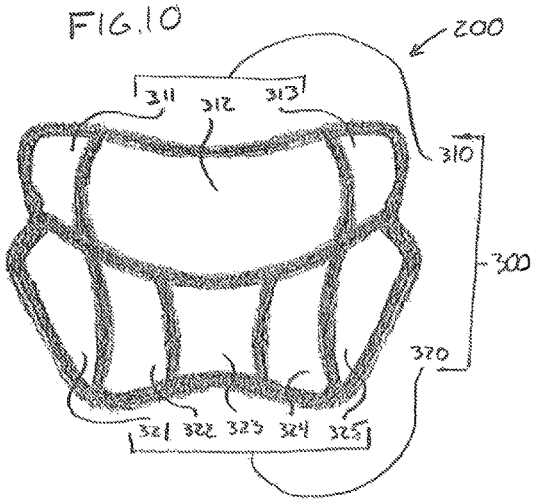
FIG. 10 illustrates a further front view of the faceguard of FIG. 4.

As shown in FIGS. 4, 9 and 10, the second horizontal wire 220 extends between opposing ends 280 and 290 of the faceguard 200 and divides a space 300, defined between the first horizontal wire 210 and the third horizontal wire 230, into an upper region 310 and a lower region 320. The second horizontal wire 220 is secured to both the first horizontal wire 210 and the third horizontal wire 230 by lateral vertical wires 240 and 270 affixed to the three horizontal wires 210, 220 and 230. The lateral vertical wires 240 and 270 subdivide the upper region 310 into a pair of upper lateral openings 311 and 313, and an upper front opening 312. As shown in FIGS. 2, 5, 7 and 8, the upper front opening 312 aligns with a user's eyes, and may be referred to as the eye opening 312.

The second horizontal wire 220 is further secured to the third horizontal wire 230 by the front vertical wires 250 and 260 affixed to the horizontal wires 220 and 230. To prevent obstruction of the user's vision through the front opening 312, the front vertical wires 250 and 260 do not extend to the first horizontal wire 210. The vertical wires 240, 250, 260 and 270 sub-divide the lower region 320 into a pair of lower lateral openings 321 and 325, a pair of lower intermediate openings 322 and 324, and a lower front opening 323.

The openings 311-313 and 321-325 are each sized and dimensioned dependent on the particular activity for which the helmet 100 is designed. In particular, if the helmet 100 is designed for use in a sport having a moving ball or other projectile then each of the openings is sized and dimensioned to prevent the ball or other projectile from passing a sufficient distance through any of the openings to contact a user's face. For example, if the helmet 100 is a softball helmet, then the openings are sized and dimensioned relative to a softball. Softballs generally have a circumference between 10 inches and 12.125 inches, and a diameter between 3.18 inches and 3.86 inches. Accordingly, an exemplary helmet 100 may be constructed with openings having particular dimensions in the "x" and "y" directions shown in FIG. 11. The upper lateral openings 311 and 313 may measure between 2.1 and 1.7 inches in the x-horizontal direction and between 2.3 and 1.5 inches in the y-vertical direction. The lower lateral openings 321 and 325 may measure between 3.6 and 1.6 inches in the x-horizontal direction and between 2.4 and 2.8 inches in the y-vertical direction. The lower intermediate openings 322 and 324 may measure between 1.8 and 3 inches in the x-horizontal direction and between 2.0 and 2.8 inches in the y-vertical direction. The upper front opening 312 may measure between 10 and 10.5 inches in the x-horizontal direction and between 1.75 and 2.6 inches in the y-vertical direction. The lower front opening 323 may measure between 2 and 2.4 inches in the x-horizontal direction and between 2 and 3.1 inches in the y-vertical direction.

Figure 11:
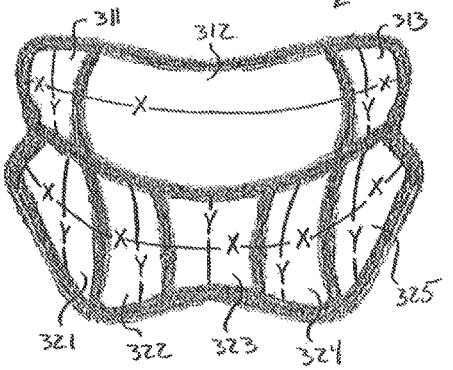
FIG. 11 illustrates a further front view of the faceguard of FIG. 4.
Figure 15:
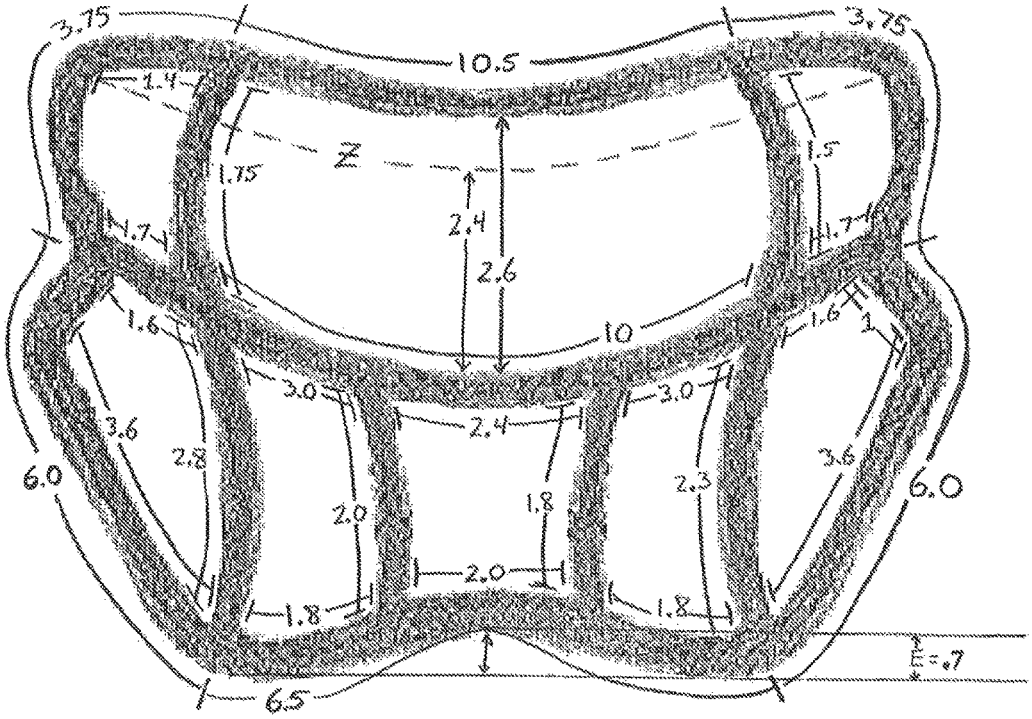
FIG. 15 illustrates an example of the faceguard of FIG. 4.

FIG. 15 shows one example of the wire grid 201 from FIG. 11, with exemplary dimensions. The dimensions in FIG. 15 are expressed in inches; and the dashed-line "Z" represents the projected bottom edge of a visor 120 of a helmet 100. As illustrated by the example of FIG. 15, the clearance of the upper opening 312, as measured when the wire grid 201 is secured to a helmet 100 (e.g., as measured from the second horizontal wire 220 to the dashed-line "Z") is less than the clearance of the upper opening 312, as measured apart from a helmet 100 (e.g., as measured from the second horizontal wire 220 to the first horizontal wire 210). In the example of FIG. 15, the wire grid 201 has a clearance of approximately 2.6 inches between the second horizontal wire 220 and the first horizontal wire 210, but has a lesser clearance of approximately 2.4 inches between the second horizontal wire 220 and bottom of a visor 120 (as represented by the he dashed-line "Z").

In an alternative example, if the helmet 100 is a baseball helmet, the "x" and "y" dimensions of the openings are instead determined relative to the dimensions of baseballs, which generally have a circumference between 9 inches and 9.125 inches, and a diameter between 2.87 inches and 2.94 inches. The same principles apply if constructing the helmet 100 for use in other athletic activities (e.g., as a hockey helmet the openings would have "x" and "y" measurements relative to the average dimensions of hockey pucks).

In other embodiments, the wire grid 201 may include additional vertical and/or horizontal wires to further narrow openings in the wire grid 201, as needed for a particular ball or other projectile, and/or to increase the strength and integrity of the wire grid 201. For example, additional vertical wires may extend between the second horizontal wire 220 and the third horizontal wire 230 through any of the openings 321-325. In another example, additional vertical wires may extend between the first horizontal wire 210 and the third horizontal wire 230 through both the openings 311 and 321 or through both the openings 313 and 325. In a further example, an additional horizontal wire may extend between the second horizontal wire 220 and the third horizontal wire 230, along the user's upper jaw and forward of the user's philtrum. Such an additional horizontal wire may be referred to as the maxilla guard.

Third Horizontal Wire 230

The third horizontal wire 230 is the lowest wire in the wire grid 201 and represents the bottom perimeter of the faceguard 200. The third horizontal wire 230 is configured, when the faceguard 200 is affixed to a mating helmet 100 and the helmet is worn by a user, to extend along the user's lower jaw and forward of the user's chin, as shown in FIGS. 2, 5, 7 and 8. As such, the third horizontal wire 230 may be referred to as the mandible guard 230.

Figure 5:
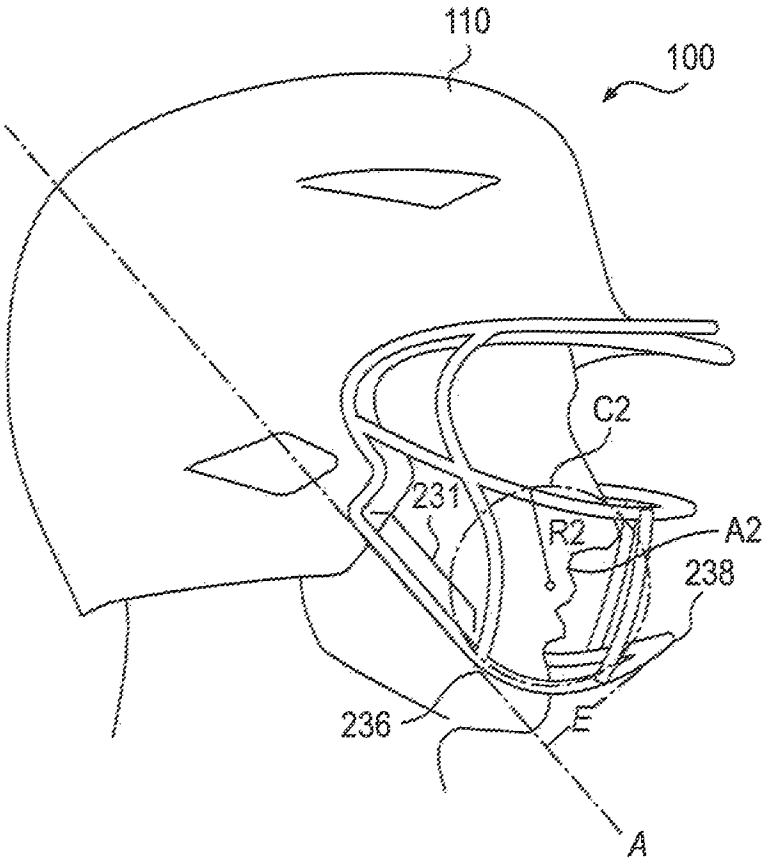
FIG. 5 illustrates a profile view of a user wearing the helmet of FIG. 3.
Figure 12:
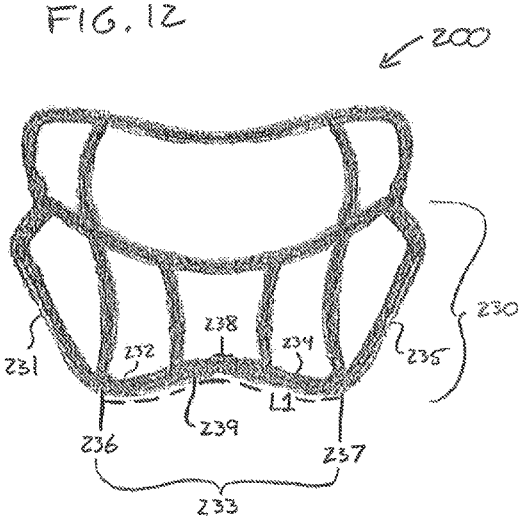
FIG. 12 illustrates a further front view of the faceguard of FIG. 4.

As shown in FIGS. 5 and 12, the third horizontal wire 230 includes parallel lateral sections 231 and 235, and a front section 233 extending between the lateral sections 231 and 235. As shown in FIGS. 4 and 5, the third horizontal wire 230 is configured such that the lateral sections 231 and 235 both extend, for a length, along a common plane "A", and such that the front section 233 deviates from and is elevated a distance "E" above the plane "A". As such, the front section 233 may be referred to as the elevated section 233, the raised section 233, or the deviated section 233.

Figure 2:
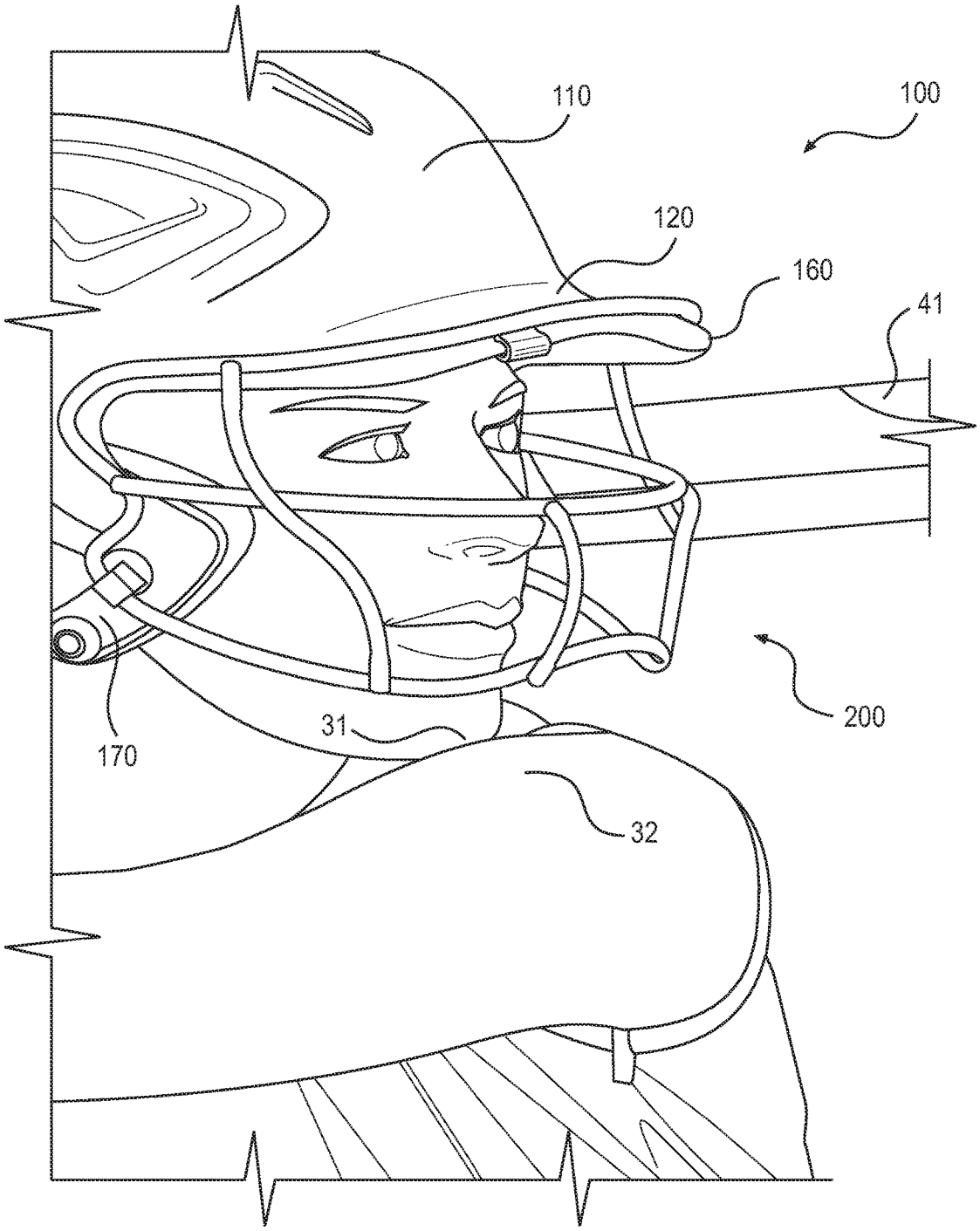
FIG. 2 illustrates a player in a batting stance wearing a helmet with a faceguard according to a first embodiment of the present invention.
Figure 3:
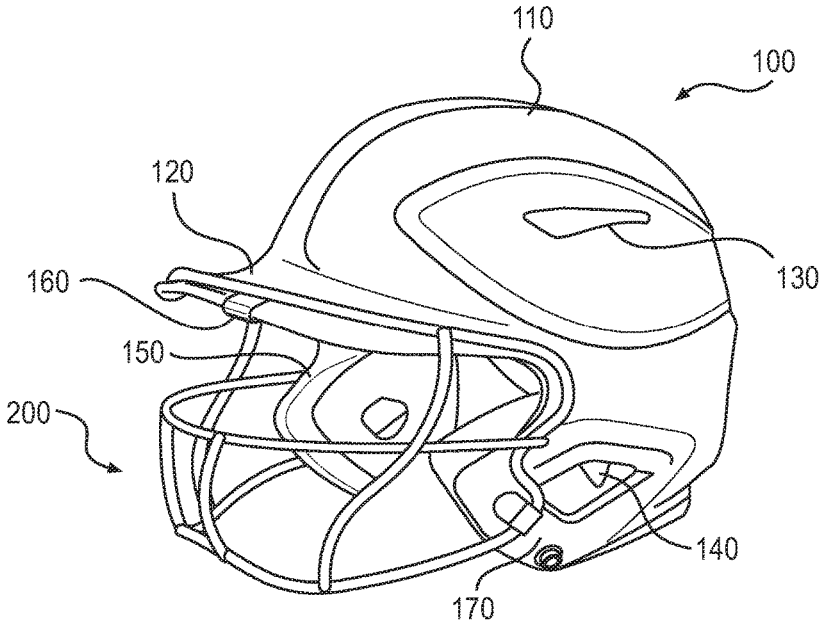
FIG. 3 illustrates a perspective view of a helmet with a faceguard according to the first embodiment.

As shown in FIGS. 2, and 8, the lateral sections 231 and 235 engage a plurality of second fasteners 170 on the shell 110, for securing the faceguard 200 to the helmet 100. The lateral sections 231 and 235 extend from the helmet 100 toward the front section 233. In one example, the second fasteners 170 are affixed to the shell 110 and engage the third horizontal wire 230. In another example, the second fasteners 170 are affixed to the third horizontal wire 230 and engage the shell 110. In yet another example, the second fasteners 170 are mating arrangements of fasteners on each of the third horizontal wire 230 and the shell 110.

Suitable structures for use as the plurality of second fasteners 170 may include: u-shaped clamps; j-shaped hooks; mating arrangements of snap-fasteners; arrangements of openings that align for reception of a secured bolt; and equivalents of the foregoing. The second fastener 170 may also include combinations of the foregoing structures. A different fastener type may be used for each of the first and second fasteners 160 and 170, or a common fastener type may be used for both the first and second fasteners 160 and 170.

As shown in FIG. 8, the front section 233 is a deviated and continuously elevated, or raised, length of the third horizontal wire 230 that extends across the sagittal plane "S" of the user's face. As shown in FIGS. 8 and 12, the front section 233 is defined between a first elevation point 236 on one side of the sagittal plane "S" and a second elevation point 237 on the other side of the sagittal plane "S". As shown in FIGS. 4 and 5, the first and second elevation points 236 and 237 are the anterior-most points of the lateral sections 231 and 235; and are the points at which the third horizontal wire 230 deviates from the plane "A".

Figure 6:
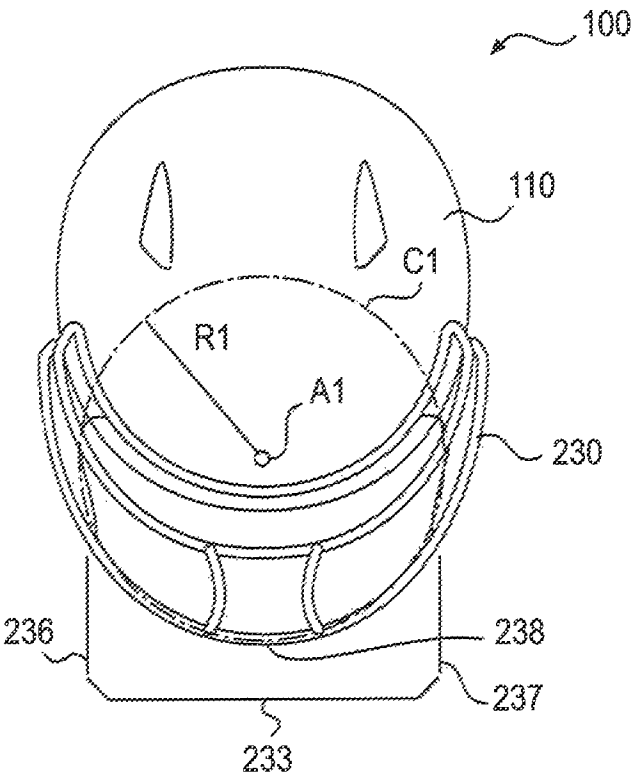
FIG. 6 illustrates a top-down view of the helmet of FIG. 3.
Figure 7:
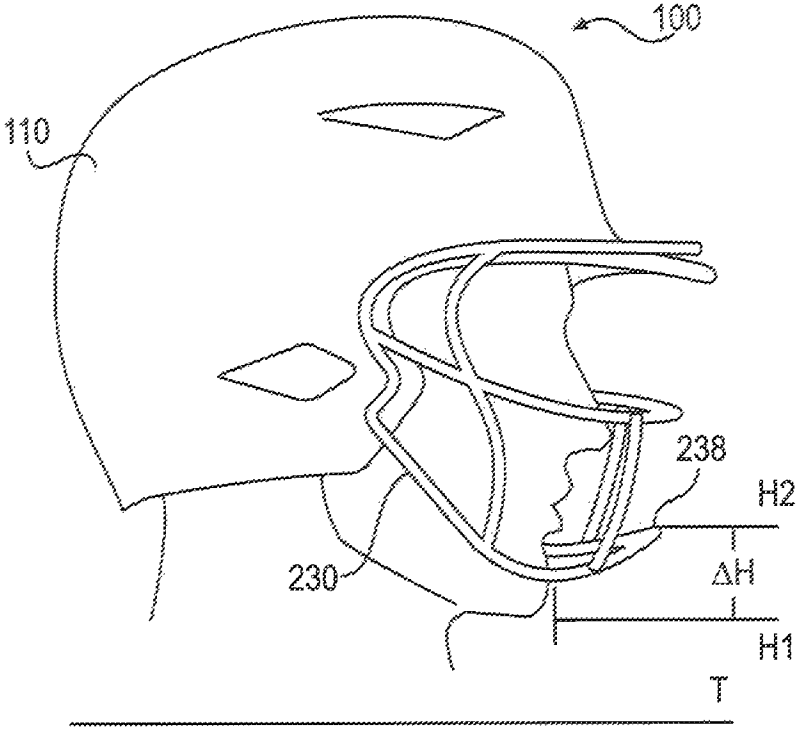
FIG. 7 illustrates a further profile view of a user wearing the helmet of FIG. 3.

As shown in FIGS. 5 and 6, the front section 233 has a first radius of curvature R1 when viewed along a first axis A1, and a second radius of curvature R2 when viewed along an axis A2 that is perpendicular to the first axis A1. As such, when viewed along the first axis A1, the front section 233 is a substantially bow-shaped section of the third horizontal wire 230 that curves around the user's face and includes an anterior point 238. As shown in FIGS. 6 and 8, the anterior point 238 is both the forward-most point of the third horizontal wire 230 and the highest point of the front section 233. The anterior point 238 is also configured to approximately align with the sagittal plane "S" of the user's face. As shown in the arrangement of FIGS. 7 and 8, when the user levels their head with the transverse plane "T", the anterior point 238 is elevated at a height H2, which is a greater height in the caudal-to-cranial direction than the height H1 of a lowest point most caudal point) of the third horizontal wire 230. As shown in FIG. 11, a distance between the anterior point 238 and a point on the second horizontal wire 220 directly above the anterior point 238 represents the shortest distance between the front section 233 and the second horizontal wire 220.

In one example, the radius of curvature R1 of the front section 233, as viewed along the axis A1 in FIG. 6, is between 2 and 4.5 inches. In another example, the radius of curvature R1 is between 3.25 and 4.25 inches. In a further example, the radius of curvature R1 is between 3.5 and 4 inches; and may be approximately 3.75 inches. In one example, the radius of curvature R2 of the front section 233, as viewed along the axis A2 in FIG. 5, is between 0.5 and 3 inches. In another example, the radius of curvature R2 is between 1 and 2.5 inches. In a further example, the radius of curvature R2 is between 1.5 and 2 inches; and may be approximately 1.75 inches.

A deviation of the front section 233 may be measured in a number of ways. In one example, as shown in FIGS. 4 and 5, the deviation of the front section 233 may be measured by an elevation "E" between the anterior point 238 and the plane "A" along which the lateral sections 231 and 235 extend. In another example, as shown in FIGS. 7 and 8, the deviation of the front section 233 may be measured, when a user wears the faceguard 200 on a mating helmet 100 and levels their head with a transverse plane "T", by a difference in height ΔH between the height H2 and the height H1.

In terms of elevation, as measured along the line "E" in FIGS. 4 and 5 between the anterior point 238 and the plane "A", the front section 233 may deviate by an elevation between 0.25 and 1.75 inches. In another example, the elevation at the anterior point 238 is between 0.5 and 1.5 inches. In a further example, the elevation at the anterior point 238 is between 0.75 and 1.25 inches; and may be approximately 1 inch.

In terms of height, as measured along the line ΔH in FIGS. 7 and 8 between the heights H2 and the height H1, the front section 233 may deviate by a difference in height ΔH between 0.25 and 1.5 inches. In another example, the difference ΔH of the front section 233 is between 0.5 and 1 inch. In a further example, the difference ΔH of the front section 233 is between 0.625 and 0.785 inches; and may be approximately 0.7 inches.

In the embodiment shown in FIGS. 4 and 5, the lateral sections 231 and 235 extend, for a length, along a common plane "A". In other embodiments, however, the lateral sections 231 and 235 may not extend, for an appreciable length, over a common plane. For example, the lateral sections 231 and 235 may instead have a continually curved shape. In such an example, the third horizontal wire 230 may continue to have a configuration whereby the anterior point 238 is at a height H2 that is greater than a height H1, as characterized by the difference ΔH shown in FIGS. 7 and 8.

As shown in FIG. 12, by the dashed line "L1", the length of the front portion 233 may be measured along the perimeter of the third horizontal wire 230 between the first elevation point 236 and the second elevation point 237. In one example, the front section 233 has a length between 2 and 15 inches. In another example, the front section 233 has a length between 4 and 8 inches. In a further example, the front section 233 has a length between 6.25 and 635 inches; and may be approximately 6.5 inches.

As shown in FIG. 8, by the dashed line "L2", an extension length of the third horizontal wire 230 may be measured from the forward-most mating point for a second fastener 170 on a first side of the sagittal plane "S" to the forward-most mating point for a second fastener 170 on a second side of the sagittal plane "S". In one example, the extension length of the third horizontal wire is (measured along the dashed line "L2") is between 11 and 17 inches. In another example, the extension length of the third horizontal wire is between 12 and 16 inches. In a further example, the extension length of the third horizontal wire is between 13 and 15 inches; and may be approximately 14 inches.

In one example, the length of the front section 233 (measured along the dashed line "L1") is between 18 percent and 88 percent the extension length of the third horizontal wire 230 (measured along the dashed line "L2"). In another example, the length of the front section 233 is between 33 percent and 50 percent the extension length of the third horizontal wire 230. In a further example, the length of the front section 233 is between 45 percent and 48 percent the extension length of the third horizontal wire 230; and may be approximately 46.5 percent thereof.

Figure 13:
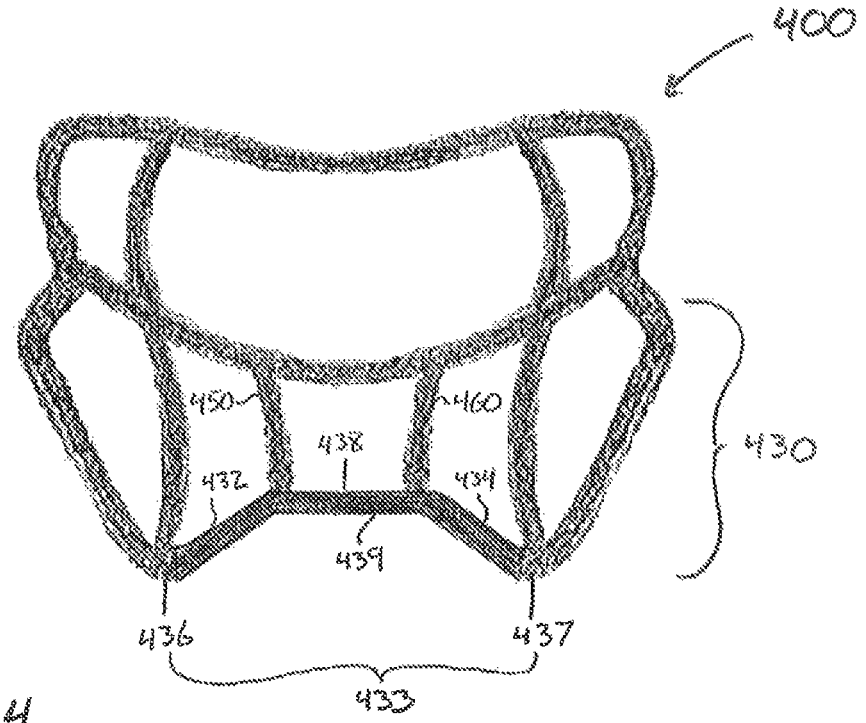
FIG. 13 illustrates a front view of the faceguard according to a second embodiment.
Figure 14:
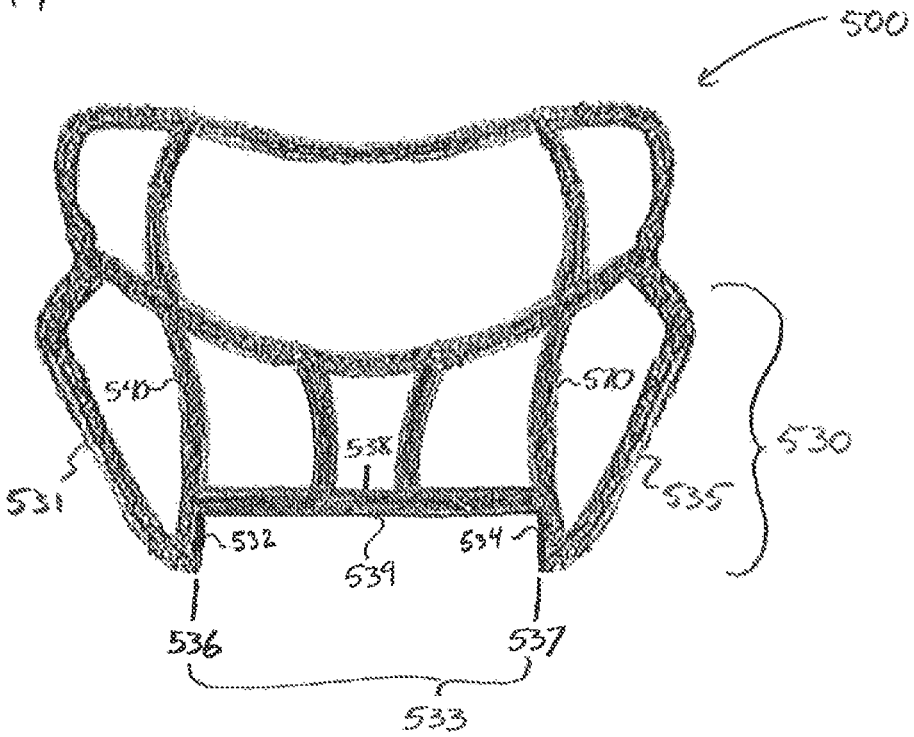
FIG. 14 illustrates a front view of the faceguard according to a third embodiment.

In the embodiment shown in FIGS. 2-12, the front section 233 has an arched or semi-oval shape, which includes curved sloping intermediate sections 232 and 234, and an arched top section 239. However, the front section 233 is not limited to such shapes. In another embodiment, as shown in FIG. 13, a faceguard 400 may be constructed with a third horizontal wire 430 having a front section 433 formed in a trapezoidal shape with straight sloping intermediate sections 432 and 434, and a top section 439. In such a configuration, the front vertical wires 450 and 460 may be affixed to the third horizontal wire 430 at corners where the intermediate sections 432 and 434 meet the top section 439. In a further embodiment, as shown in FIG. 14, a faceguard 500 may be constructed with a third horizontal wire 530 that is constructed in a rectangular shape with intermediate sections 532 and 534 that extend vertically upward from elevation points 536 and 537 (in a caudal-to-cranial direction), and a top section 539 that extends horizontally between the intermediate sections 532 and 534 at approximately a 90' right angle. In such a configuration, the lateral vertical wires 540 and 570 may be affixed to the intermediate sections 532 and 534 at corners where the intermediate sections 532 and 534 meet the top section 539.

In examples of the faceguards 400 and 500, the respective top sections 439 and 539 may, or may not, be slightly arched and/or slightly bow-shaped. With an arch configuration, an anterior point (438 or 538) will be the single point of the top section (439 or 539, respectively) that is at both the peak elevation "E" and the greater height H2. Alternatively, without an arch shape, the entirety of the top section (439 or 539) will extend horizontally at a constant height such that the entire top section is at the same peak elevation "E" and the same greater height H2 as the anterior point (438 or 538, respectively). With a bow-shape, the anterior point (438 or 538) will be the single forward-most point of the top section (439 or 539, respectively). Alternatively, without a bow-shape, the top section (439 or 539) will extend horizontally at a common anterior distance as the anterior point (438 or 538, respectively). In the embodiment of faceguard 500, if the top section 539 extends horizontally across the sagittal plane "S" at a constant anterior distance, then lateral sections 531 and 535 extend sufficiently forward of the user's face, in a profile view, to provide clearance for the top section 539 in front of the user's face.

In the forgoing embodiments, the lateral vertical wires are affixed to the third horizontal wire proximate to the first and second elevation points. In other embodiments, however, the lateral vertical wires may be affixed either further away from the sagittal plane "S" (e.g., at a location along the lateral sections of the third horizontal wire), or closer to the sagittal plane "S" (e.g., at a location along an elevated portion of the front section of the third horizontal wire).

With a third horizontal wire (as the bottom perimeter of the faceguard) having an elevated front section, faceguards according to the foregoing examples both protect the players face, including their chin, while at the same time avoiding interference with the player's batting stance and swing mechanics. In particular, the elevated front section of the third horizontal wire permits a player, when batting, to tuck their shoulder close to their chin without contacting faceguard and without the faceguard interfering with their freedom of movement when swinging a bat.

Methods of Manufacture

The faceguard 200 may be constructed and shaped from metal or plastic. Suitable metals may include: aluminum, steel, carbon, cobalt, chromium, iron, nickel, magnesium, tin, titanium, zinc, cast metals, and combinations thereof. Suitable plastics may include high impact plastics, such as polycarbonate, reinforced fiber plastics, carbon fiber, and combinations thereof. If constructed from metal, these components may be shaped by processes such as; stamping; pressing; spinning; casting; and combinations of the foregoing. Alternatively, if constructed from plastic, these components may be shaped by processes such as: blow molding; injection molding; extrusion; vacuum molding; hot-pressing; three-dimensional layering; and combinations of the foregoing.

When forming the faceguard 200, one or more of the wires may be formed separately and affixed to one another to construct the wire grid 201. For example, each individual wire may be drawn into a straight rod, shaped with a desired curvature through one or more bending techniques, and welded to one another to construct the wire grid 201. Alternatively, a single metal rod may be bent to achieve the desired shape for one or more of the wires. For example, the first horizontal wire 210 and the third horizontal wire 230 may be constructed from a single perimeter wire that extends along the lengths identified as: the first horizontal wire 210, the opposing end 290, the third horizontal wire 230, and the opposing end 280. In a further aspect, all of the wires in the wire grid 201 may be constructed as a single monolithic structure (e.g., by a casting or molding shaping process).

The wires of wire grid 201 may be constructed with a number of shapes. In one example, the wires are constructed as rounded rods. In another example, the wires have a rectangular shaped cross-section. In alternative examples, the wires may be flat bars, or bars having tapered cross-sections (e.g., wedge-shaped, oval shaped, etc.), and may be oriented to display a narrowed width in a user's field of view, thereby increasing the strength and integrity of the wire grid 201 while also minimizing both the interference to a user's field of view and the weight of the faceguard 200. The wires of the wire grid 201 may be constructed with either solid cross-sections or hollow-cross sections. Wires constructed with a hollow cross-section may have a larger cross-sectional perimeter. For example, a wire constructed with a solid rectangular cross-section may have a perimeter measuring 0.150 inches×0.257 inches, whereas the same wire constructed with a hollow rectangular cross-section may have a perimeter measuring 0.235 inches×0.325 inches. In some examples, some of the wires may be constructed with a first shape (e.g., rectangular or oval) and a first cross-section type (e.g., solid or hollow), while other wires in the wire grid 201 are constructed with a second shape and/or a second cross-sectional type.

In embodiments where the wires are made from a metal material, a protective coating may be applied to the wires to prevent deterioration of the metal and/or any welding materials. Suitable protective coatings may include a bonded vinyl powder coating, dipped rubber coatings, and equivalents thereof.

Suitable structures for use as one or more of the fasteners may include: one or more u-shaped clamps; one or more j-shaped hooks; mating arrangements of snap-fasteners; an opening adapted to receive a secured bolt therethrough; an opening adapted to receive a looped strap; a mating hook-and-clasp; a mating buckle-and-opening; and the like. If permanently affixing one or more components together then a fastener may be substituted by, or may include: welding; a monolithic construction (e.g., casting, molding, etc.); an integrated construction (e.g., closed or substantially-closed loops secured around a narrowed region in a received structure); and combinations of the foregoing.

Although the present invention has been described with reference to particular embodiments, it will be understood to those skilled in the art that the disclosure is exemplary only and that various other alternatives, adaptations, and modifications may be made within the scope and spirit of the present invention.

For example, although the foregoing examples have been discussed relative to softball helmets, those skilled in the art will appreciate that the invention is also applicable to other athletic headgear, as well as other headgear not limited to athletic use. The invention may also include additional features, if desired, including features that are known and used in the art.

To the extent necessary to understand or complete the disclosure of the present invention, all publications, patents, and patent applications mentioned herein are expressly incorporated by reference to the same extent as though each were individually so incorporated. In addition, ranges expressed in the disclosure are considered to include the endpoints of each range, all values in between the end points, and all intermediate ranges subsumed by the end points.

The present invention is not limited to the specific embodiments as illustrated herein, but is instead characterized by the appended claims.

What is claimed is:

1. A faceguard for a batting helmet, comprising:

a wire grid comprising a plurality of horizontal wires, wherein the plurality of horizontal wires comprises a horizontal wire configured to extend proximate to a user's nose, and a horizontal wire configured to extend proximate to a user's chin, wherein the horizontal wire configured to extend proximate to a user's chin comprises a pair of lateral sections that engage a shell of a batting helmet, and a front section that extends between the lateral sections, wherein the lateral sections and the front section of the horizontal wire configured to extend proximate to a user's chin form a single, continuous wire, wherein the lateral sections extend along a common plane, and the front section deviates from the plane along which the lateral sections extend, and wherein the front section comprises an anterior point disposed between a first elevation point and a second elevation point, wherein the first and second elevation points have a first height in a caudal-to-cranial direction, wherein the anterior point is configured to approximately align with the sagittal plane and is elevated at a second height in a caudal-to-cranial direction that is 0.25 inches to 1.5 inches greater than the first height, and wherein the first height is less than the height at any point on the lateral sections in a caudal-to-cranial direction.

2. The faceguard of claim 1, wherein the front section comprises intermediate sections that extend from the lateral sections, and a top section that extends between the intermediate sections, and the intermediate sections are sloping intermediate sections that slope away from the plane along which the lateral sections of the third horizontal wire extend.

3. The faceguard of claim 2, wherein the sloping intermediate sections are curved sloping sections.

4. The faceguard of claim 2, wherein the sloping intermediate sections are straight sloping sections.

5. The faceguard of claim 2, wherein the plurality of horizontal wires further includes a horizontal wire configured to conform to a visor portion of a batting helmet.

6. The faceguard of claim 1, wherein the front section has a first curvature when viewed along a first axis, and a second curvature when viewed along a second axis perpendicular to the first axis.

7. The faceguard of claim 1, wherein the length between the anterior point of the front section and a point on the horizontal wire configured to extend proximate to a user's nose vertically above the anterior point is the shortest length between the front section and the horizontal wire configured to extend proximate to a user's nose.

8. A faceguard for a helmet, comprising:

a shield member having a top perimeter and a bottom perimeter, wherein the top perimeter is configured to engage the shell of a helmet, wherein the bottom perimeter comprises a pair of lateral sections configured to extend along a user's lower jaw, and a front section configured to extend between the lateral sections and forward of a user's chin, wherein the lateral sections and the front section of the bottom perimeter form a single, continuous wire, and wherein the front section of the bottom perimeter comprises an anterior point that is configured to approximately align with the sagittal plane and the anterior point is elevated at a height, in a caudal-to-cranial direction, that is 0.25 inches to 1.5 inches greater than the height of a lowest point in the front section, and wherein the lowest point in the front section extends below any point in the lateral sections in a caudal-to-cranial direction.

9. The faceguard of claim 8, wherein the anterior point of the front section is elevated at a height, in a caudal-to-cranial direction, that is greater than the height of a lowest point in the bottom perimeter.

10. The faceguard of claim 8, wherein the top perimeter is configured to conform to a visor portion of a helmet.

11. The faceguard of claim 8, wherein the bottom perimeter has a first curvature when viewed along a first axis, and a second curvature when viewed along a second axis perpendicular to the first axis.

12. A faceguard for a helmet, comprising:

a mount joined with a mandible guard, wherein the mandible guard comprises a pair of lateral sections that are configured to extend along a user's lower jaw, and a front section that extends between the lateral sections and forward of a user's chin, wherein the lateral sections and the front section of the mandible guard form a single, continuous wire, wherein the front section has a first curvature when viewed along a first axis, and a second curvature when viewed along a second axis perpendicular to the first axis, and wherein the front section comprises an anterior point disposed between a first and second elevation point, wherein the first and second elevation points are each elevated to a first height in a caudal-to-cranial direction, wherein the anterior point is configured to approximately align with the sagittal plane and is elevated at a second height in a caudal-to-cranial direction that is 0.25 inches to 1.5 inches greater than the first height, and wherein the first height is less than the height of any point in the lateral sections in a caudal-to-cranial direction.

13. The faceguard of claim 12, wherein the front section is configured to extend across the sagittal plane of the user's face.

14. The faceguard of claim 12, wherein the mount is configured to conform to a visor portion of a helmet.

15. A method of making protective headgear, comprising forming the faceguard of claim 1 by shaping the wire grid from a metal or plastic material.

16. A method of making protective headgear, comprising forming the faceguard of claim 8 by shaping the shield member from a metal or plastic material.

17. A method of making protective headgear, comprising forming the faceguard of claim 12 by shaping the mandible guard from a metal or plastic material.

18. The faceguard of claim 1, wherein the second height is 0.25 inches to 1.5 inches greater than the first height.

19. The faceguard of claim 8, wherein the anterior point is elevated at a height, in a caudal-to-cranial direction, that is 0.25 inches to 1.5 inches greater than the height of a lowest point in the front section.

* * * * *